US011229948B2

(12) United States Patent
Simancik et al.

(10) Patent No.: US 11,229,948 B2
(45) Date of Patent: Jan. 25, 2022

(54) METHOD OF PRODUCTION OF COMPONENT FROM METAL FOAM, COMPONENT PRODUCED BY SAID METHOD AND MOULD FOR THE REALIZATION OF SAID METHOD

(71) Applicant: USTAV MATERIALOV A MECHANIKY STROJOV SAV, Bratislava (SK)

(72) Inventors: Frantisek Simancik, Bratislava (SK); Lubomir Pavlik, Ziar nad Hronom (SK); Jan Spanielka, Cinobana (SK); Peter Tobolka, Bratislava (SK)

(73) Assignee: USTAV MATERIALOV A MECHANIKY STROJOV SAV, Bratislava (SK)

( * ) Notice: Subject to any disclaimer, the term of this patent is extended or adjusted under 35 U.S.C. 154(b) by 339 days.

(21) Appl. No.: 15/756,318

(22) PCT Filed: Dec. 15, 2015

(86) PCT No.: PCT/IB2015/059639
§ 371 (c)(1),
(2) Date: Feb. 28, 2018

(87) PCT Pub. No.: WO2017/037522
PCT Pub. Date: Mar. 9, 2017

(65) Prior Publication Data

US 2018/0257135 A1 Sep. 13, 2018

(30) Foreign Application Priority Data

Aug. 28, 2015 (SK) ..... 50046-2015
Dec. 14, 2015 (SK) ..... 50082-2015

(51) Int. Cl.
*B22D 25/00* (2006.01)
*B22F 3/11* (2006.01)
(Continued)

(52) U.S. Cl.
CPC ..... *B22D 25/005* (2013.01); *B22D 23/06* (2013.01); *B22F 3/1118* (2013.01);
(Continued)

(58) Field of Classification Search
None
See application file for complete search history.

(56) References Cited

U.S. PATENT DOCUMENTS

2002/0127425 A1* 9/2002 Wolfsgruber ..... B22F 3/1125 428/613
2014/0190652 A1* 7/2014 Baumgartner ..... B22D 17/263 164/113

FOREIGN PATENT DOCUMENTS

JP 2525414 * 8/1996

OTHER PUBLICATIONS

Banhart, J., "Industrialisation of Aluminium Foam Technology", Proceedings of the 9th Int'l Conf. on Aluminium Alloys 2004, Institute of Materials Engineering Australasia Ltd., pp. 764-770. (Year: 2004).*

(Continued)

*Primary Examiner* — Xiaobei Wang
(74) *Attorney, Agent, or Firm* — Defillo & Associates, Inc; Evelyn A Defillo

(57) ABSTRACT

Foamable semifinished product (1) in the form of granules produced from the metal alloy and the foam agent is inserted into the cavity of the closable mould (2) and the liquid (3) with the density that is higher than the apparent (or bulk) density of the resulting foam is led to it. The liquid has a temperature which is higher than the temperature of the (Continued)

melting of the metal alloy; the transfer of the heat to the particles of the foamable semifinished product (1) takes place; it subsequently expands, whereby it is supported by the liquid (3). During the expansion at least part of the liquid (3) is pushed by the expansion itself out of the mould (2) through the opening. The liquid (3) allows the regulation of the pressure of the environment of the foam agent, too, which helps to set exactly the moment of expansion. The metal melt can be advantageously used as liquid (3). The melt can partially remain in the mould (2) so the hybrid structure of the component is created. The new method makes the foaming significantly quicker, it secures the homogeneity of the metal foam, simplifies the moulds and diminishes the energy demands for the whole process.

14 Claims, 8 Drawing Sheets

(51) Int. Cl.

| | |
|---|---|
| ***B22F 7/08*** | (2006.01) |
| ***C22C 1/04*** | (2006.01) |
| ***C22C 21/02*** | (2006.01) |
| ***C22C 21/00*** | (2006.01) |
| ***C22C 21/06*** | (2006.01) |
| ***B22D 23/06*** | (2006.01) |
| ***C22C 21/08*** | (2006.01) |

(52) U.S. Cl.
CPC ..... *B22F 3/1125* (2013.01); *B22F 7/08* (2013.01); *C22C 1/0416* (2013.01); *C22C 21/00* (2013.01); *C22C 21/02* (2013.01); *C22C 21/06* (2013.01); *C22C 21/08* (2013.01); *B22F 2301/052* (2013.01); *B22F 2998/10* (2013.01)

(56) References Cited

OTHER PUBLICATIONS

Kyocera, "Zirconia", <https://global.kyocera.com/prdct/fc/list/material/zirconia/zirconia.html>, accessed Mar. 11, 2020.*

* cited by examiner

METHOD OF PRODUCTION OF COMPONENT FROM METAL FOAM, COMPONENT PRODUCED BY SAID METHOD AND MOULD FOR THE REALIZATION OF SAID METHOD

CROSS REFERENCE TO RELATED APPLICATION

This application is a national stage entry of PCT/IB2015/059639 filed Dec. 15, 2015, under the International Convention claiming priority over Slovak Patent Application No. PP50046-2015 filed Aug. 28, 2015 and Slovak Patent Application No. PP50082-2015 filed Dec. 14, 2015.

FIELD OF THE INVENTION

The invention concerns the method of production of components from metal foam, mainly complex and sizeable components, whereby the invention allows fast, regular and controlled foaming in the mould. The invention also describes a mould which is advantageously used for the foaming and the component produced by the new method of distribution of heat during foaming.

PRIOR STATE OF THE ART

Four methods are currently used to produce components from metal foam:

direct foaming of the molten metal, or melt, by means of a gas poured into the melt or a by means of a foaming agent mixed into the melt, which disintegrates after being added to the melt, which produces the gas, casting a metal alloy into suitable mould, the cavity of which creates an exact structure of the resulting metal foam, whereby—by means of a suitable depositing method—this mould creates a model from a polymer foam, which is subsequently removed from the mould by a suitable method, direct deposition of the metal by a method of the 3D pressing or onto a suitable polymeric model of the foam which is subsequently removed, foaming of the solid semifinished product containing, besides the metal alloy forming a final foam structure, the additive foam agent (usually powder metal hybrid or carbonite), whereby the foamable semifinished product placed in the suitable mould is heated to the temperature of the melting, where the gas pores are produced in the melted metal alloy by means of disintegration of the foam agent, which expands the foamable semifinished product until it fills the entire cavity in the mould.

All abovementioned methods have their significant limitations, which—despite the unusual characteristics—do not allow the industrial mass production of components from metal foam.

Direct foaming of the melt runs into problems concerning the even distribution of the gas or particles of the foam agent, respectively, in the melt, because the gas or the foam agent have to be added to the melt gradually and have to be mixed appropriately. This causes the uneven foaming of the different parts of the melt, which moreover needs to be appropriately stabilized by addition or creation of a stabilizing ceramic particles, so the collapse of the first pores does not happen unless the whole volume of the melt is filled. The mixing of the melt is in itself a problem, too, which does not allow the production of the complex, sizable readymade components, because the mixers cannot be conveniently placed in the moulds. This method usually limits the production to the less complex and smaller metal foam components such as blocks, panels, etc., too. The complexly shaped components are produced by the mechanical machining.

The deposition methods are too slow and costly and do not allow the production of sizable complex components because of the possibilities offered by current deposition devices; the subsequent heat processing of the produced foams is complicated, too.

The foaming of the solid semifinished product allows a direct production of the readymade shaped components if the semifinished product is allowed to expand in the suitable cavity of the mould until the cavity is filled. The mixer is then not necessary, because the foaming agent is evenly distributed in the semifinished product, which can be produced by pressing of the powder mixture of the metal alloy and the powder of the foaming agent, or by mixing the powder of the foaming agent into the melt during increased pressure when the gases are not released, and in subsequent casting and solidification of the mixture prepared in this way into the desired shape of the semifinished product. The problem is the evenness of the subsequent filling of the component, because the semifinished product is in the closed cavity heated gradually from its outer sides, which causes the premature foaming in the vicinity of the walls of the mould and the bits of the semifinished product in the middle of the form often rest unfoamed. In order to prevent the collapse of pores touching the wall of the mould, the wall of the mould must have a temperature which is close to the temperature of the melting of the metal alloy, which significantly slows down the process of foaming. The mould needs to be thin-walled, because the whole transfer of the heat into the semifinished product which is necessary for the melting runs through the wall of the mould, with small temperature difference. The moulds which lack a good heat conductance—for example, sand or ceramic shell ones—are therefore of no use. Most often the thin-walled metal moulds are used, but these are being deformed due to continually changing temperature and heat stress and it is therefore necessary to replace them often, so the dimensions of the final product within desired margin of error are achieved. Alternatively the moulds produced from graphite are used; these have good dimensional stability, but they are prone to damage during high temperatures and it is necessary to protect them from oxidation. Large and complexly shaped components therefore cannot be effectively produced in this way. Moreover, the length of the process of foaming diminishes the productivity and increases the overall costs, because a parallel work of multiple and relatively expensive moulds and devices is needed.

Such simple solution is desired and not known which would ensure the even distribution of the heat towards the foamable semifinished product, mainly in form of granules, whereby the solution allows not only to speed up the process, but also to control it in order to achieve the desired characteristics of the foam structure.

SUMMARY OF THE INVENTION

The abovementioned deficiencies are greatly remedied by the method of production of the components from metal foam according to the present invention. The essence of the invention lies mainly in the new method of the heating of the foamable semifinished product in the cavity of the mould, which ensures its fast and even melting without the need for protracted, gradual transfer of the heat through the wall of the mould, and therefore without the risk of overheating of the foam which can result in the collapse of the pores by the edge of the wall of the mould.

The foamable semifinished product is inserted into the cavity of the mould which has an intake for the melt. After the insertion of the foamable semifinished product, for example granules (or granulate) in the weighed amount, the mould is flooded by the suitable liquid through the intake, whereby this liquid has a temperature that is higher than the temperature of the melting of the foamable semifinished product. The liquid is able to flow in evenly and quickly; it is able to permeate the inside of the mould, which means that the sufficient amount of heat, necessary for the foaming, is basically "poured" into the mould. During the flowing of the liquid to the mould and after the filling of the mould with the liquid, the liquid instantly enters into a direct contact with each bit of the foamable semifinished product, whereby it transfers heat to the product until the temperatures of liquid and product mutually even out. Such transfer of the heat is significantly faster and spatially more even than the gradual transfer from the surface of the form and the subsequent process of the mutual transferring of the heat between foaming particles of the foamable semifinished product. The gradual transfer of the heat between individual elements of the system—as it has been hitherto used during the production of the metal foams from the solid semifinished product—is in this invention substituted for the direct influence of the heated liquid in all bits of the foamable semifinished product at the same time. The required amount of heat—sufficient for the heating and melting of the foamable semifinished product—is accumulated into the liquid in advance. The particular amount of heat depends on the specific heat of the used liquid, on the ratio of the weight of the foamable semifinished product and the liquid, on the specific heat of the foamable semifinished product, on the latent temperature of melting of the foamable semifinished product and on the difference between the temperature of the foamable semifinished product in the mould and the temperature of the liquid. In this way, the amount of the heat necessary for the perfect foaming of the foamable semifinished product can be exactly set—after taking account of the heat losses to the walls of the mould—by means of the setting of the temperature of the liquid for the given amounts of the foamable semifinished product and the liquid.

The set foamable semifinished product starts to expand immediately through production of the gas pores by means of a foam agent and its relative density therefore begins to significantly diminish. The apparent density (or bulk density) represents a ratio of the weight of the porous structure emerging from the semifinished products to its current volume. Pore-less melt has a density that is obviously higher than the apparent density of the foam. The produced foam is therefore pushed to the upper part of the cavity of the mould by the force of gravity, whereby the weightier melt gathers in its lower part. The function of the liquid is therefore not only to transfer the heat, but it also helps the movement of the particles of the foamable semifinished product at the phase when these particles expand. The use of the liquid has a significant synergetic effect; the liquid transfers the heat quickly and at the same time simplifies the distribution of the semifinished product during foaming. The liquid is pushed out by the expanding semifinished products through the outlet back out of the mould to the suitable collecting vessel. The main process finishes when the foamable semifinished product expands to the desired value, whereby it fills in a certain part of—or the whole of—the cavity of the mould and by doing so the surplus liquid is pushed out of the mould after transferring the sufficient heat. The process finishes with the cooling of the mould until the finished foam does not solidify completely.

Usually the method according to this invention includes a step where the foamable semifinished product in the form of the granules produced, for example, from the mixture of the metal alloy powder and foam agent, is inserted into the cavity of either closable or one-off, disposable mould. The term "granules" or "granulate" must be understood broadly, without dimensional limitations; it can include any solid grains, bodies, particles. Usually—but not exclusively—the granules will be formed into the rods, profiles or sheets. The term "foamable" expresses the ability to suitably foam the metal material. It follows from the abovementioned that to a significant degree the foamable semifinished product will have a foamable agent gas-tightly closed by the metal material, so during the release of the gas from the agent the foaming of the metal takes place and the gas is not released outside the structure of the metal to any significant degree.

The liquid with the higher density than the apparent density of the resulting metal foam is released into the cavity of the mould, whereby the liquid has a temperature that is higher than the temperature of the melting of the powder of the metal alloy. By placing the liquid into the mould the liquid is put in contact with the foamable semifinished product in the cavity of the mould. This contact leads to immediate transfer of the heat from the liquid to the foamable semifinished product; the foamable semifinished product is therefore heated to the temperature of the melting of the metal alloy, which causes the foamable semifinished product to expand, whereby at least part of the expanding semifinished product is floating in the liquid. The desired expansion is accompanied by the outflow of at least part of the liquid from the mould through the respective opening in the mould; preferably the liquid is pushed out by the expansion of the foamable semifinished product itself. After reaching a desired degree of the expansion the mould is cooled to the temperature of the solidification of the produced metal foam.

Part of the suitably chosen liquid can remain in the mould on purpose, where it solidifies there with the foam and produces a hybrid casting combining the solidified foam and solidified liquid into a single monolithic component.

The liquid can be placed into the mould mainly by pushing through the opening in the lower part of the mould, preferably in the bottommost part of the mould. The same opening can then be used for the outflow of the liquid. During expansion, 75% of the liquid is pushed out of the mould, preferably more than 90% of the liquid is pushed out.

In order to achieve the effects according to this invention it is necessary that the liquid fills in the whole free space in the cavity of the mould. The free space remaining in the cavity of the mould after the insertion of the foamable semifinished product can be filled by the liquid only partially. In such case the liquid and the foamable semifinished product before the expansion have a smaller volume than the inner volume of the cavity of the form. The amount of the required liquid can be minimalized, which minimalizes the required size of the devices for the heating and conduction of the liquid in such a way that the free space remaining in the cavity of the form after the insertion of the foamable semifinished product is filled in by the liquid only in the amount which is necessary for the direct contact of the liquid with the surface of the foamable semifinished product. That means that the particular amount of the liquid will depend mainly on the weight and granulometry of the foamable semifinished product, and it can be specified by the test on site.

The liquid that has flown out of the mould can be, without cooling, used in another cycle of foaming, which significantly diminishes the energy demands for the production of the components from the metal foam. The term "without cooling" denotes the state where the liquid is not intentionally cooled, which does not exclude common heat losses during its storage until another cycle of foaming. What is crucial is that in another cycle only the heat which has been consumed in the previous cycle is added into the liquid, because the liquid does not solidify and it is not necessary to add further latent heat. Usually the liquid during the outflow from the mould flows into the collecting vessel below the mould, where it can be subsequently heated for the repeated use.

In a preferable arrangement the liquid is connected with the molten metal. The melt can be an alloy with the similar chemical composition as the metal powder in the mixture of the foamable semifinished product, but it can also differ to a certain degree from such composition. If a melt with a higher temperature of solidification than the foam is used, the intake will solidify firstly, whereby the expanding foam will remain under the pressure of the produced gas until the complete solidification, which secures the thorough filling of the details even in the complex cavity of the form. If the melt with the temperature of solidification that is lower than the temperature of the solidification of the metal foam is used, the foam will be the first to solidify in the cavity of the mould and the surplus melt in the intake can be subsequently poured out. During the solidification of the melt a suitable pressure can be applied onto the melt in the intake, so the solidification of the foam proceeds similarly to the previous case.

In order to produce foam components, it is preferable to use such a melt which does not react with the melted foam in any way (for example, a lead and a tin in case of the aluminum foam); in certain cases it is preferable to use alloy instead, though, which diffusely joins the produced foam, whereby a hybrid casting comprising partly from the solidified melt and the part of the foam can be produced. In that way the melt from the alloy that is identical to the alloy from which a metal foam is composed can be used.

The cavity may be designed in such a way that under the influence of the expansion of the foamable semifinished product all of the melt pours out. Usually in such case the intake into the mould will be placed at its bottommost point. It is, however, possible that on the inner surface of the cavity an artificial obstacles (folds) or caps—that is, different shape elements—can be formed, whereby the melt cannot be pushed out of them by the foam. The melt will be held in these shape elements or it will be held in the mould—on the level of these shape elements—until the solidification, which produces a hybrid casting with the solidified melt on its surface with the thickness corresponding to the shape of the cavity or the shape and position of the shape element, respectively. The hybrid casting can also be produced in such a way that the intake for the liquid—used simultaneously for the outflow of the liquid during the expansion—is placed above the level of the bottom of the cavity of the mould, and above this bottom the liquid remains until the solidification. It is naturally possible that a person skilled in art can on this basis produce various shapes of moulds even without unusual invention, whereby one can have various shape elements in the forms of the ribs, braces and so on. One can use the mould with multiple intakes or with controlled intakes and outflows of the liquid at various places and in varying height with regard to the mould.

It is also possible to insert various reinforcing nets (or grids) which copy the inner surface—or at least part of the surface—of the mould into the cavity with the foamable semifinished product and allow the poured melt to reach the surface of the mould, whereby the appropriate setting of the size of the mesh does not allow the expanding semifinished product to push the melt out from beneath the net. In this way, the compact pore-less layer reinforced—on top of that—by the net from the suitable metal can be produced on the surface of the foam; the net significantly improves the mechanical features of the resulting component mainly during its stressing by the tensile stress, because the net and the compact layer prevent—similarly as the reinforced concrete—the potential cracks in the foam from spreading.

The reinforcement with the perforated surface not only increases the features of the casting in terms of the solidity, but the perforation also produces a separating element during the casting—a boundary between the mass of the foamed material and the solidified pore-less liquid. An appropriately designed perforation in the reinforcement therefore has a double function: it increases the resilience of the casting with regard to tensile stresses and, at the same time, it produces the pore-less layer on the surface of the foam, which—as a sieve—prevents the expanding foam from penetrating through the openings in the reinforcement and from pushing the melt out beyond the reinforcement. The temperature of the melting of the material of the reinforcement must be higher than the temperature of the liquid; the reinforcement can be, for example, from steel or from some other metals with high temperature of melting or from ceramic fibres.

The metal and/or ceramic reinforcements—for example in forms of nets, grids, expanded metal, rods, hollow profiles, wires or fibres—are inserted into the cavity of the mould even before the placement of the foamable semifinished product; usually the reinforcement will be placed into the mould before the pouring in of the liquid.

The mould can be pre-heated to the temperature of the liquid or the melt, respectively, so that the liquid or the melt does not prematurely solidify during the pouring to the cavity of the mould; the mould can also be produced from the material which poorly transfers the heat—for example, from the sand mixture or ceramic—which is a demand that runs directly counter to the prior state of the art. In case of the pre-heating of the mould to the temperature of the solidification of the foam, it is necessary to appropriately cool the mould after the foaming finishes. Before the placing of the liquid to the mould the mould can be heated to the temperature that is higher than the temperature of the melting of the foamable semifinished product.

Considering the fact that the process of the disintegration of the foam agent depends on the temperature and pressure, in a suitably set up production method the suggested process of the foaming can be realized in short instants (in orders of seconds) by means of the manipulation with the external pressure. It is known that increasing the temperature above the critical temperature spontaneously releases the gas from the foam agent, whereby the critical temperature increases with the increasing pressure. If the process of the casting takes places in the autoclave and the pre-heated melt is poured into the mould with the foamable semifinished product during the increased outside pressure which pushes the temperature of the disintegration of the foam agent above the temperature of the melting of the semifinished product (in the case of aluminum foams TiH2 it is, for example, a pressure above 1 MPa), the semifinished product will not expand even after total melting. However, the expansion starts immediately when the external pressure decreases below the critical value. This feature can be used to better even out the temperature in the cavity of the mould after the pouring in of the melt, because it allows to get more time for the evening out of the temperatures between individual pieces of the semifinished product and the melt without the expansion of the semifinished product. The expansion starts after the temperature is evened out by the decrease in the outside pressure. In this phase the liquid can therefore function as a control of the launching of the controlled expansion, because the set up outside pressure is evenly and practically instantly applied to each piece of the semifinished product. This means that in the mutual contact of the liquid with the foamable semifinished product the liquid is under pressure which is at the given temperature higher than the pressure that prevents the foam agent from releasing gas necessary for foaming and expansion. Even better transfer of the heat from the melt to the semifinished product takes place at higher pressure, whereby the expansion needs not to take place at all. This step can therefore postpone expansion until the moment the temperature field is evened out inside the mould. Before the diminishing of the temperature of the liquid towards the level of the temperature of the solidification of the liquid the pressure in the liquid is controlledly diminished below the value preventing the foam agent from releasing the gas at a given pressure, which starts the expansion. This method is preferable mainly in cases of complicated shapes of the castings, of long paths of the movement of the liquid in the cavities of the mould, of different distances between the intake and the edges of the cavity, and so on.

Autoclaves can be advantageously used in order to produce the pressure, where the increased pressure acts upon the structure of the mould from outside, too. This allows the advantageous use of the thin-walled shell mould with low production costs. The use of classical construction of the pressure mould is not excluded, too, whereby this mould is capable of enduring the excess of internal pressure. The solutions with the two-coat moulds are possible, too; between the solid outer coat and inner thin-walled pressure medium there is a pressure medium.

It is also known that with increasing outer pressure during the foaming the size of the resulting pores decreases. This phenomenon can be used in the method according to this invention in order to set the size of pores in such a way that after the beginning of the expansion the remaining pressure in the autoclave the remaining pressure or the pressure acting upon the outflowing melt from the intake, is kept at the appropriately set level. Aside from launching the expansion the liquid therefore is a pressure medium regulating the size of the pores, which is depicted on the FIG. 33.

Alternatively the described flowing of the cavity of the mould with the inserted foamable semifinished product can be realized reversely in such a way that the pieces of the foamable semifinished product are put (or inserted) into the open mould, already filled with the pre-heated liquid or melt, respectively, whereby the mould is closed in such a way that the expanding foam does not leak from the cavity before it pushes out the surplus liquid or melt. A suitable opening in the lower part of the cavity of the mould is required for this.

The subject matter of the invention is also the component according to the present invention. The component can be a part of the bodywork of a mean of transport or it can form a whole monolithic bodywork in one piece and one work cycle. The current constructions of bodyworks are significantly affected by the technological possibilities related to the shaping of the sheet metal parts, which are then welded or otherwisely connected together into the spatial structure. This invention allows to produce spatial structure which is not limited by the shaping technologies and subsequent connection. In cases of frames and/or bodyworks of the means of transport (vehicles, airplanes, trains, ships) the component can in one whole include the skeleton or framework and outer shaped surfaces as well. Individual zones of the bodywork or framework can have a changing width of the metal foam; they can have gradual transitions of the connecting joints, the production of which is complicated and limited in the case of the sheet metal construction. The spatial structure can have zones with the solidified liquid and/or reinforcement.

The subject matter of the invention is also the mould according to the present invention. The mould does not need the walls designed for the fast transfer of the heat and it needs not to be a metal one either. Coefficient of the thermal conductivity of the material of the mould can be less than 70 $W \cdot m^{-1} \cdot K^{-1}$. In the preferable arrangement the mould is produced by the drying of the suspension containing ceramic particles, which is applied onto the meltable model of the component, preferably a wax model of the component. The mould can be divided and usually will have at least one opening for the intake and outflow of the heat-transferable liquid in its bottom part.

The invention with the usage of a single liquid for the transfer of the heat, the movement of the particles of the foamable semifinished product and subsequent launching of the expansion brings a whole lot of important advantages, mainly:

It allows the expansion of the foam in the short instant in the whole volume of the cavity of the mould regardless its size, which means that even sizable complex component of complex shape and large dimensions (for example monolithic car bodywork similar to the bodyworks produced from carbon composite) can be achieved by this method with high productivity;

The foam is produced in whole volume in the short instant, which significantly increases the regularity of the distribution of the pores and it prevents the collapse of the prematurely created pores as well as diminishing the volume of the empty spaces;

Any material can be used for the production of the mould, including cheap ceramic mixtures for the production of the shells or sand mixtures, because the heat does not need to be transferred into the semifinished product through the wall of the mould, but it gets there by means of a pre-heated liquid;

Practically all of the heat carried to the liquid is consumed for the purposes of melting of the foamable semifinished product with the minimal losses in the walls of the mould. If an enduring mould is used, it can be kept at the temperature of the foaming by means of the loss heat which is transferred to it during the solidification of the foam. This significantly decreases the energy demands for the foaming, because the heating of the mould does not require any additional heat and practically only the heat necessary for the melting of the semifinished product that has been consumed in the previous process of foaming is carried to the melt which is during the whole process in the molten state. This energy effectiveness diminishes the costs of the whole process;

A suitable choice of the melt, foamable semifinished product and the shape of the surface of the cavity of the mould allows the production of the hybrid castings with the parts without pores formed by the solidified melt, whereby the expanding foam within the cavity of the mould prevents the creation of shrinkages resulting from the solidification of the melt (the expansion of the foam compensates the shrinking of the volume of the melt as a result of the solidification). In this way it is possible to produce sandwich structures with the compact surface layer of the desired width and with foam core, which have excellent mechanical characteristics mainly from the point of view of the achieved solidity and firmness relative to the weight;

It allows to simply realize the foaming in the conditions of changing external pressure (the pressure is carried equally on all parts of the semifinished product by means of the liquid or melt, respectively) which significantly directs the size of the resulting pores and the regularity of their distribution. The manipulation with the external pressure moreover allows to significantly shorten the process of the foaming itself, so it lasts only few seconds.

The disclosed method according to this invention can be used for the production of any shape components from the granules made of metal alloy with suitable foam agent. The preferable compositions of the solid foamable semifinished products are known in the prior state of art and they are commonly used for the common construction alloys. The applications for the production of the large, complexly shaped components from the metal foam will be especially advantageous, as well as the production of hybrid castings (metal-foam) in a single technological operation. The use of the invention is expected everywhere where light, monolithic constructions with the high ratio of solidity and firmness to the weight of the component are needed, mainly during production of car bodyworks and their components, the ship and airplane constructions, the light sizable construction parts for electric vehicles, tricycles, trailers, railroad vehicles, trains, and so on. The market can expand the applications which can currently be produced only from composites with the carbon or glass fibers, but carbon or glass fibers are very expensive materials and do not meet the demands for high productivity and repeatability of the production. The disclosed method elevates the foaming to highly productive level with short production cycle, whereby the thin-walled shell can be used as a mould even for large components.

The production of the large components from a single piece in one production cycle not only diminishes the number of parts and joint elements, but it also improves the transfer of the mechanical load (or stress) in the component. The invention offers many synergic advantages which follow from the fast and homogenous insertion of heat directly to the inside of the mould, whereby the carrier of the heat comes into direct contact with the granules of the foamable semifinished product. Thanks to this the productivity of the casting as well as the repeated stability of the processes increase significantly and the energy demands diminish.

BRIEF DESCRIPTION OF DRAWINGS

The invention is further disclosed by drawings 1 to 43. The used scale and the particular shape of the mould and the respective product are not binding; they are informative or adjusted for the purposes of clarity. This is why there is a mould with the simply shaped cavity on the drawings, even in cases where a particular example verbally describes different shape character of the casting.

FIG. 1 depicts the placement of the foamable semifinished product into the mould before the pouring of the liquid;

FIG. 2 shows the foamable semifinished product into the mould when pouring of the liquid;

FIG. 3 shows the activation of the foaming;

FIG. 4 shows the continuation of the activation of the foaming;

FIG. 5 subsequently depicts the expansion of the foamable semifinished product, whereby the expansion pushes the liquid into the collecting vessel;

FIG. 6 shows on a lower left corner a pictogram showing the recyclation of the liquid, which is moved from the collecting vessel and used once again;

FIG. 7 shows that the reinforcement is placed into the mould in such a way that its perforated surface is adjacently placed at the distance from the inner walls of the mould;

FIGS. 8 to 12 show the steps similarly to FIGS. 2 to 6;

FIG. 13 depicts the mould with the casting in the solidified state. The black color marks the solidified liquid without the foam structure.

FIG. 14 shows the casting without the mould;

FIG. 15 shows the casting with the removed intake system;

FIG. 16 is spatially depicted cross-section of the mould, whereby the view shows the bare reinforcement from the expanded metal, which—through its perforation—creates a boundary between the foamed mass and the solidified melt;

FIG. 17 is a cross-sectional view of the partially cut-out reinforcement;

FIG. 18 shows the placement of the foamable semifinished product inside the mould before the pouring of the liquid;

FIG. 19 shows foamable semifinished product inside the mould while pouring of the liquid;

FIG. 20 depicts the activation of the foaming;

FIG. 21 shows the continuation pf the activation of the foaming;

FIG. 22 then depicts the expansion of the foamable semifinished product where this expansion pushes the liquid into the collecting vessel.

FIG. 23 shows in the lower left corner a pictogram meaning the recyclation of the liquid which is moved from the collecting vessel and is repeatedly used;

FIG. 24 depicts the mould with the casting in the solidified state. Full black color marks the solidified liquid without the foam structure;

FIG. 25 shows a casting without the mould;

FIG. 26 shows the casting with the removed intake system where the ribs and the lower part of the casting are created by the solidified liquid;

FIG. 34 depicts the foamable semifinished product inside the mould before the pouring of the liquid;

FIG. 35 shows the foamable semifinished product inside the mould during the pouring of the liquid;

FIG. 36 depicts the pushing of the liquid out to the collecting vessel after the decrease in pressure and subsequent expansion;

FIG. 38 depicts the mould at the start of the process;

FIG. 39 the mould is filled with liquid;

FIG. 40 depicts the step where the foamable semifinished product is put into the contact with the liquid, whereby the mould closes at the same time;

FIG. 41 depicts the beginning of the expansion of the foamable semifinished product, which correlates with the pushing of the liquid out of the mould;

FIG. 42 shows the continuing expansion;

FIG. 43 shows the filling out of the cavity of the mould.

EXAMPLES OF THE REALIZATION

Example 1

Figure 1:
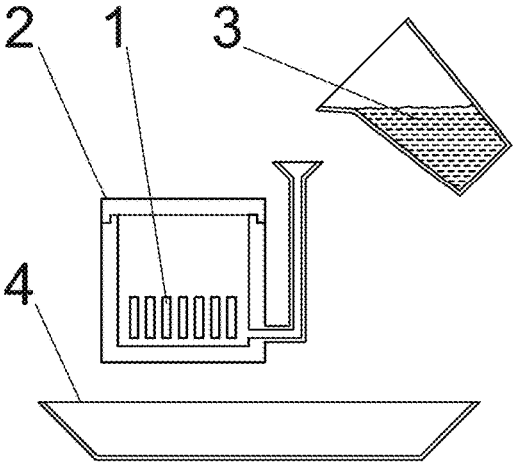
FIGS. 1 to 6 gradually depict the basic steps in one cycle of foaming in the divided mould.
Figure 2:
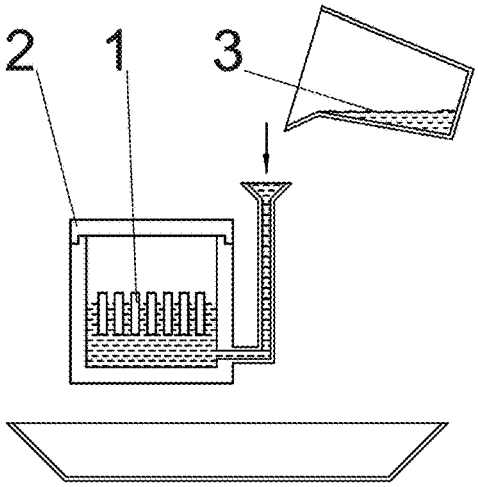
Figure 3:
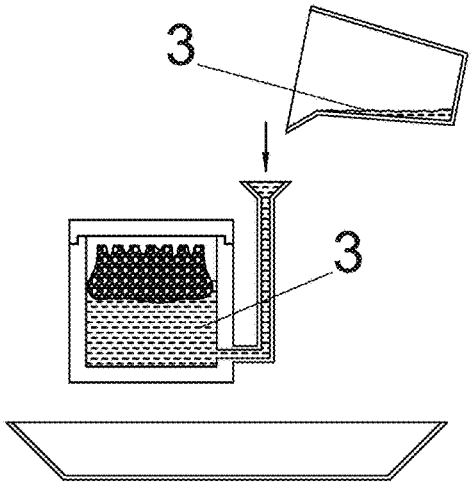
Figure 4:
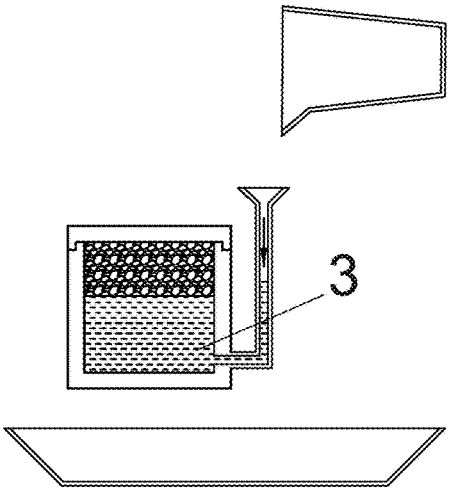
Figure 5:
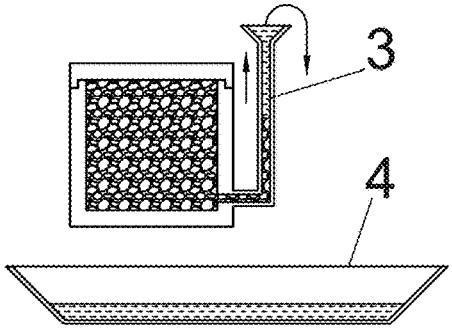
Figure 6:
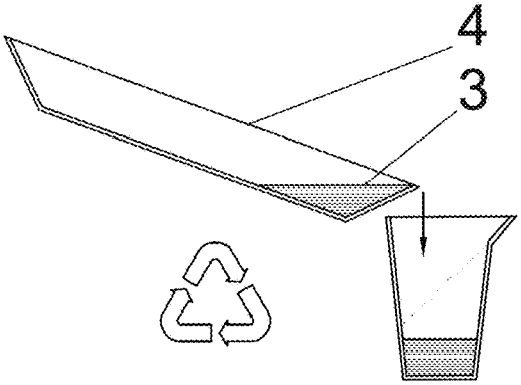
Figure 7:
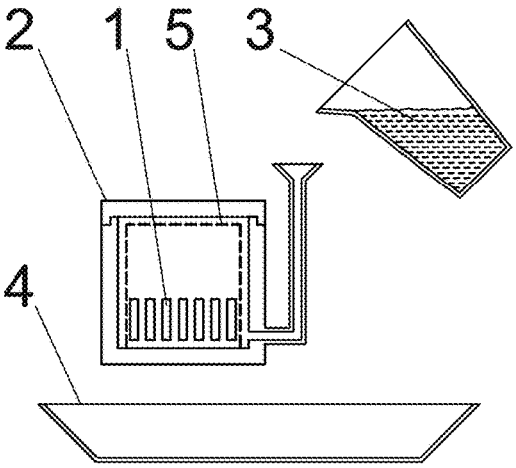
FIGS. 7 to 17 disclose the use of the separating reinforcement from the stainless expanded metal.
Figure 8:
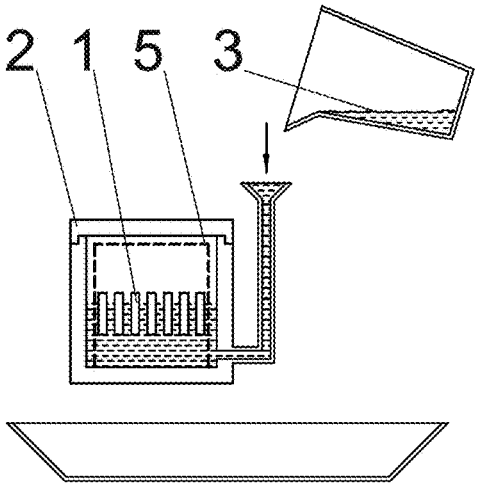
Figure 9:
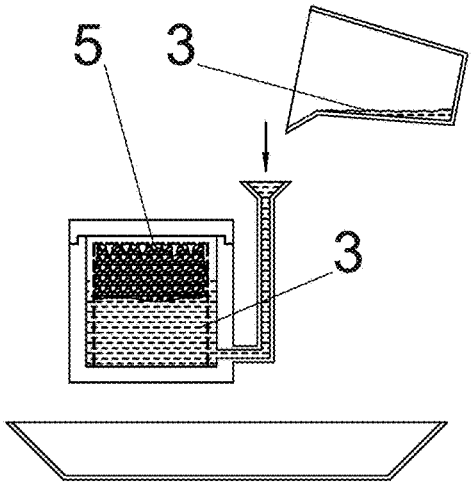
Figure 10:
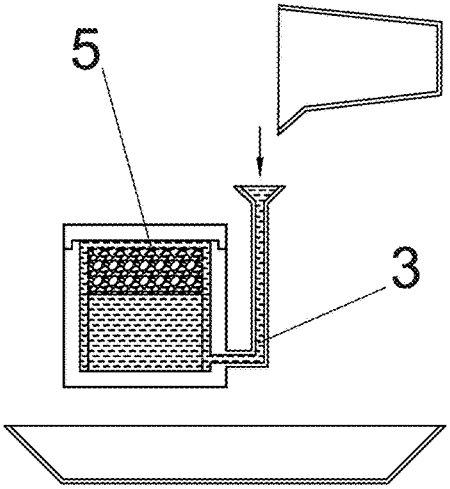
Figure 11:
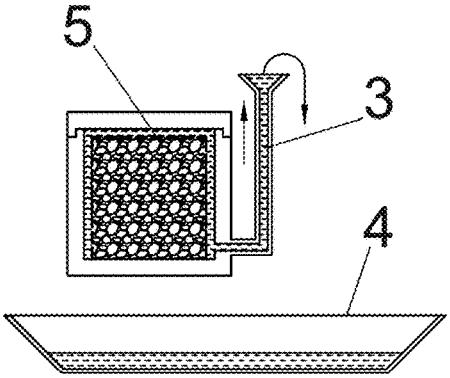
Figure 12:
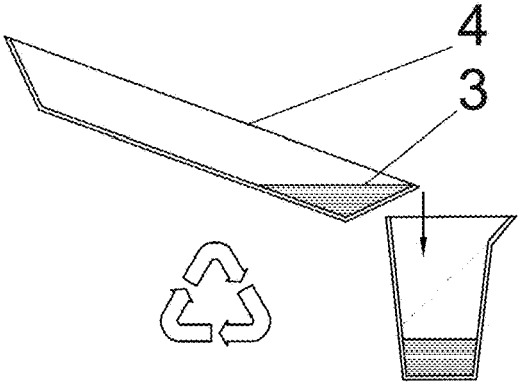
Figure 13:
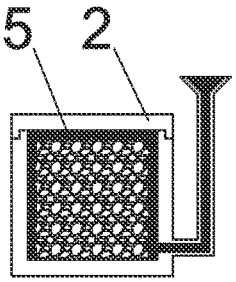
Figure 14:
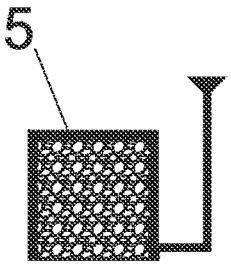
Figure 15:
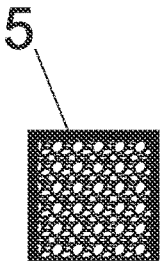
Figure 16:
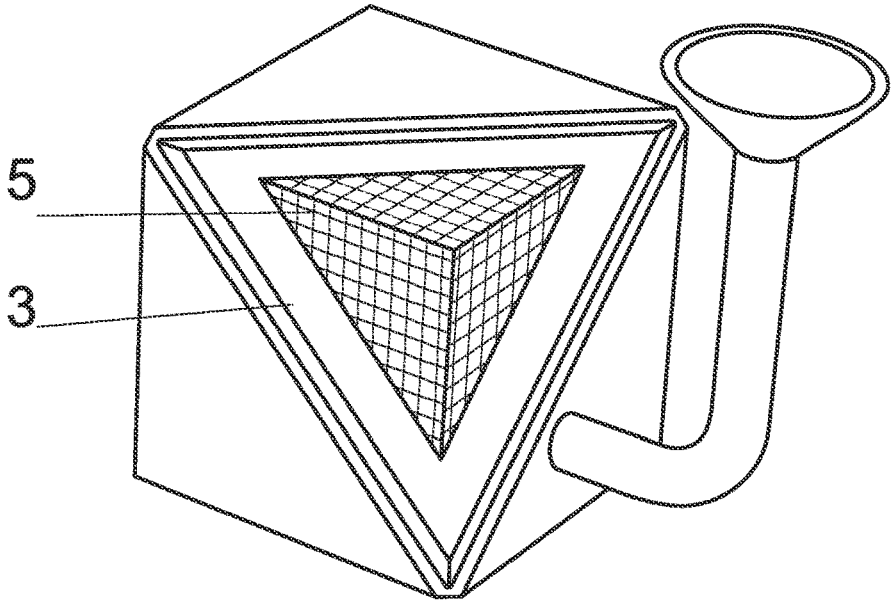
Figure 17:
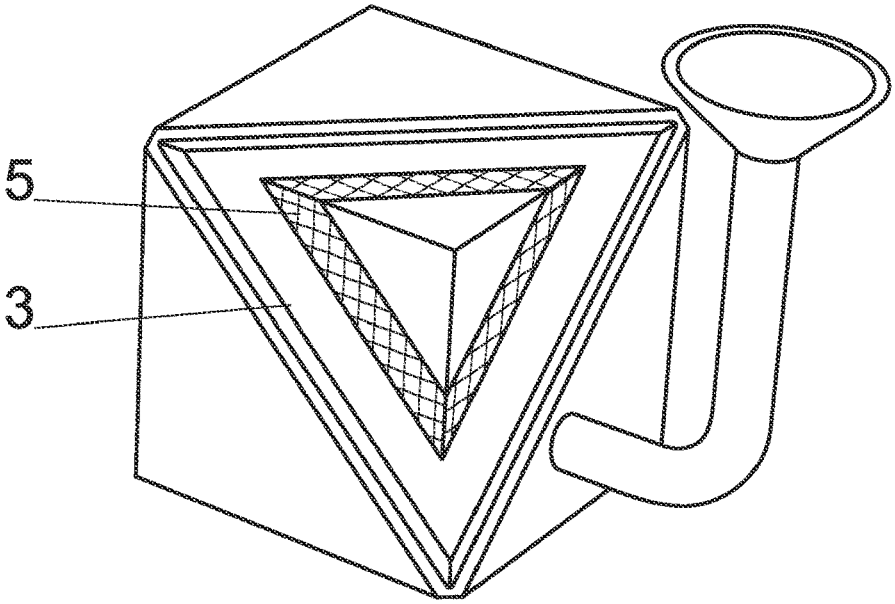
Figure 18:
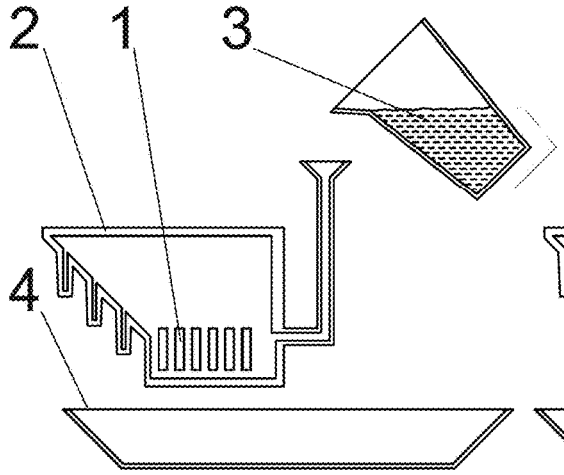
FIGS. 18 to 26 depict the method where the mould has a shape elements which effectively prevent the pushing of the liquid out from certain areas of the mould.
Figure 19:
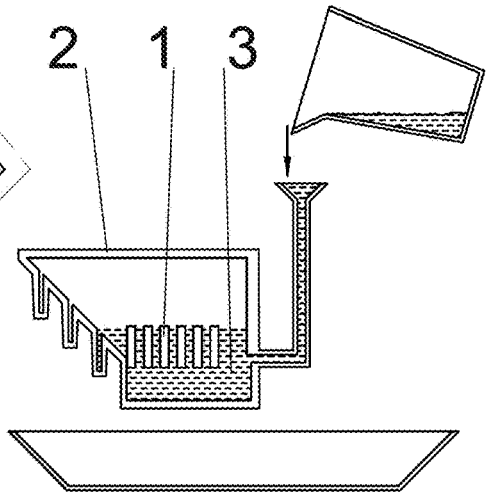
Figure 20:
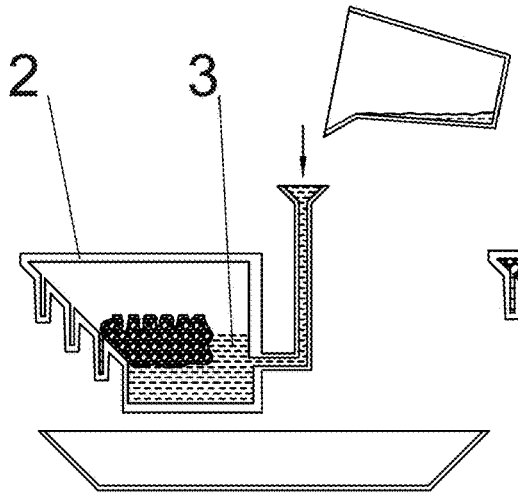
Figure 21:
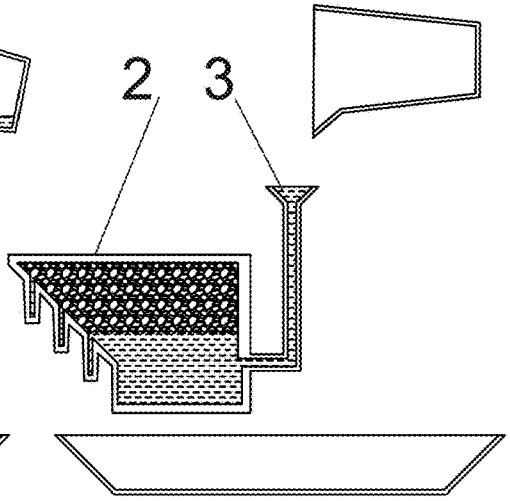
Figure 22:
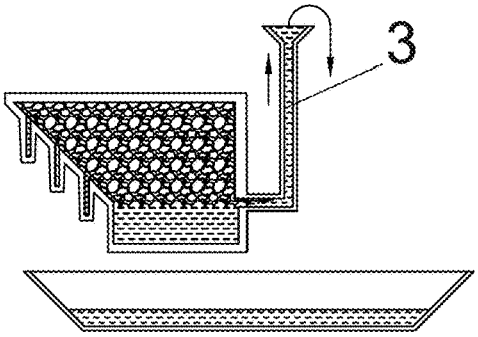
Figure 23:
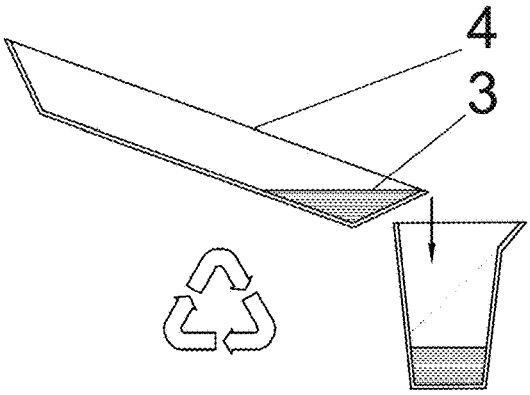
Figure 24:
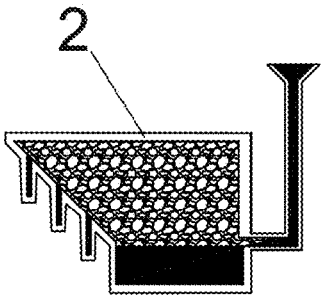
Figure 25:
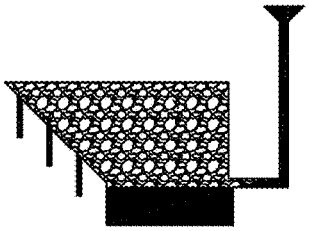
Figure 26:
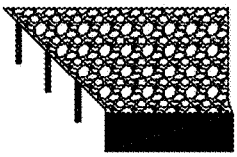
Figure 27:
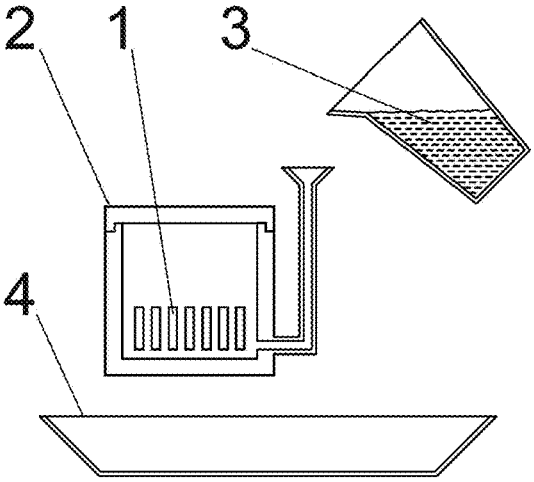
FIGS. 27 to 32 depict the steps of the foaming in the mould, where at the end the pressure of the liquid is increased; the latter event is depicted on the FIG. 32.
Figure 28:
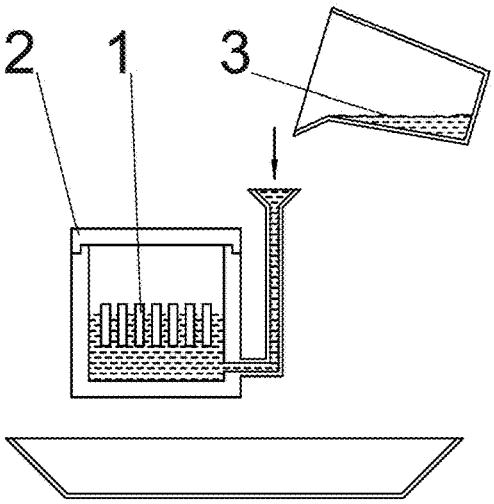
Figure 29:
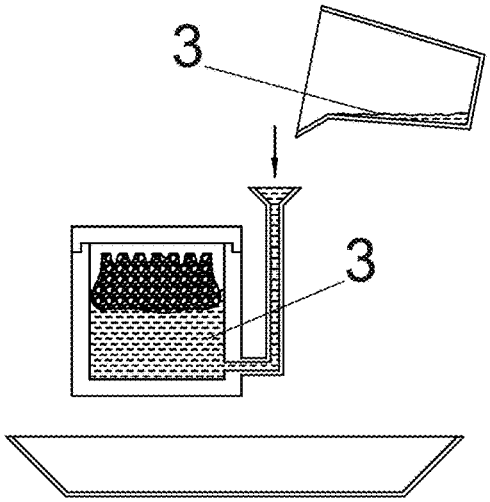
Figure 30:
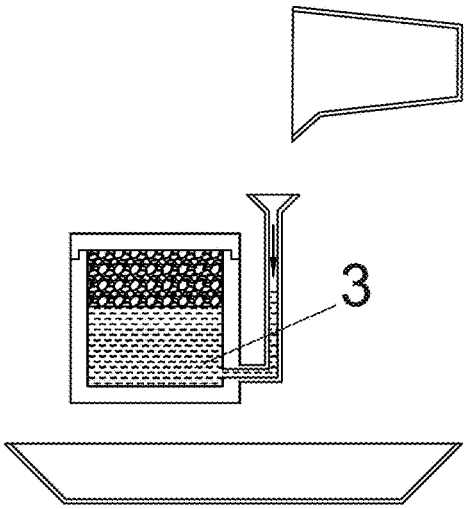
Figure 31:
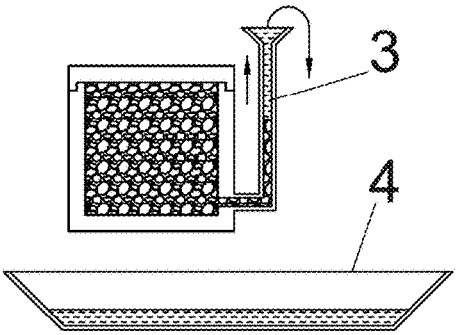

In this example according to FIGS. 1 to 6 the foamable semifinished product 1 in form of granules is produced from the powder metal alloy AlSi10 and 0.8 weight % powder of the foam agent $TiH_2$. The granules are inserted into the cavity of the two-piece foundry graphite mould 2, which in its bottommost part has an intake for the melt, whereby the pouring opening into the intake leads out above the highest point of the cavity of the mould 2. The volume of the foamable semifinished product 1 takes up approximately 20% of the inner space of the mould 2. The closed mould 2 with the foamable semifinished product 1 is—in the protective atmosphere of the nitrogen—heat to 550° C., where there is no expansion of the foamable semifinished product 1. After the evening out of the temperature of the mould 2 and granules the melted alloy AlSi10 pre-heated to 900° C. has been—according to the FIG. 2—poured into the mould 2 from outside of the furnace through the intake in such a way that at least 80% of the free space in the cavity of the mould 2 is filled in. Immediately, that is, approximately 2 seconds after the pouring of the melt into the mould 2, the foamable semifinished product 1 is melted and expands according to FIGS. 3 and 4, which is manifested by reverse flow of the liquid 3, that is, the melt flows out of the intake to the collecting vessel 4 under the mould 2. The outflow of the melt ceases after approximately 20 seconds which is a signal that the expansion of the granules (or granulate) is finished. The mould 2 which has been already placed outside the furnace is left for cooling to temperature of approximately 450° C. After the opening the finished component is taken out of the mould 2; the component is completely produced by the aluminum foam with the overall porosity being 83%. Whole melt poured into the mould 2 has been pushed by the expansion of the foamable semifinished product 1 outside the cavity of the mould 2; part of the foam is in the intake opening.

Example 2

Figure 33:
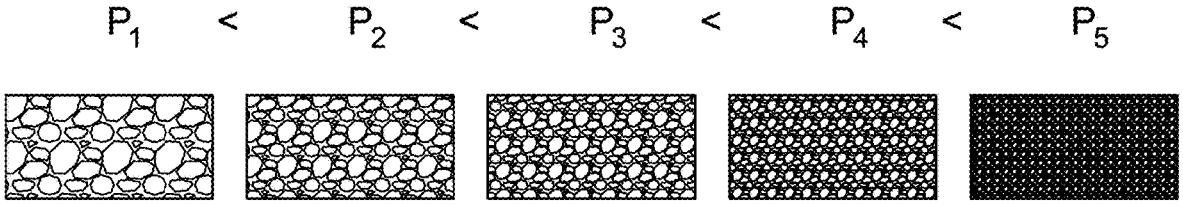
FIG. 33 shows the effect of the pressure on the foam. P1 to P5 denote the increasing pressure. The figures under the individual pressure represent an example of the structure.

The granules of the foamable semifinished product 1 were in this case according to the FIG. 33 prepared from the powder aluminum alloy AlMgSi and 1 weight % of the powder of the foam agent $TiH_2$. The granules were inserted into the cavity of the thin-walled mould 2 welded from the steel metal sheet. The volume of the semifinished product 1 occupied approximately 20% of the inner space of the mould 2. In the upper part the mould 2 has circular air vents with diameter 0.2 mm and in lower part it has a circular opening with diameter 15 mm. The mould 2 together with the foamable semifinished product 1 has been hanged in the special autoclave above the pot with the melted lead whose temperature is 950° C. After the closing of the autoclave its inner space has been pressurized by the nitroged to 1 MPa (10 atm). Subsequently the mould 2 has been completely dipped into the melted lead which has flowed slowly into the cavity of the mould 2, which is allowed by the air vents in it upper part which lead above the level of the molten lead.

After the mould 2 is completely filled in with the liquid lead (approximately 30 s) and after 1 minute the whole granules are melted in the mould 2, which manifests itself by the decrease of the temperature in the mould 2 to approximately 680° C., but the granules practically do not expand due to the pressure. The pressure in the autoclave is subsequently diminished to 0.15 MPa (1.5 atm), which causes the immediate expansion of the granules and the pushing of the lead out of the mould 2 through the bottom opening. The aluminum foam does not get out through the upper air vents because they are too small for the foam and moreover they lead to the part that is cooler than the molten lead, where the used aluminum alloy solidifies and closes the air vents. During the expansion the mould 2 was pulled out of the pot with the lead in such a way that the bottom opening remains dipped in the lead melt. After the putting out of the mould 2 from the pot the aluminum foam solidifies under the influence of the lower temperature in the space, whereby until the expansion of the granules takes place until their total solidification. The outflow of the foam through the bottom opening is prevented by the cap from the lead melt. After the total solidification of the aluminum foam at approximately 580° C. almost whole cavity of the mould 2 is filled in by the aluminum foam; only the area in the bottom opening contains the molten lead with the temperature of solidification temperature below 400° C., which after the complete pulling out of the mould out of the pot flows back into the pot.

With regard to the remaining overpressure of 0.15 MPa in the autoclave the apparent diameter of the pores in the aluminum alloy is limited to 2 mm at maximum, whereby the apparent density of the foam was 0.55 $g/cm^3$.

Example 3

In this example according to FIGS. 7 to 17 the foamable semifinished product 1 in form of granules is prepared from the powder aluminum alloy AlMg1Si0.6 and 0.6 weight % of the powder of the foam agent $TiH_2$. The granules are poured in the silicone mould 2 into the wax model of the shape component. The grid from the stainless expanded metal with the mesh size of approximately 1.5 mm is placed into the silicone mould 2 in such a way that it copies the surface of the mould 2 while keeping the distance from the inner wall. The grid in the finished product fulfills the function of the reinforcement 5, too. The volume of the foamable semifinished product 1 occupies approximately 20% of the volume of the wax model. The wax model has been dipped into the ceramic suspension by the known methods and dried by the known methods, too, until the continuous ceramic shell with thickness of approximately 4 mm is produced on the model. After the drying of the shell with the wax the opening has been created in its lower part and the wax has been melted away from it completely at the temperature of approximately 100° C. The foamable granules and the stainless grid remain in the cavity of the shell mould 2, though, whereby the grid copies the mould's 2 surface. The intake produced from the material similar to the shell is placed onto the opening in the bottom part in such a way that it leads into the cavity at the height of approximately 20 mm above the lowest part of the cavity of the mould 2.

The shell with the intake, granules and stainless grid are subsequently heated to the temperature 550° C. and then the melted aluminum alloy AlMg1Si0.6 heated to the temperature 850° C. is poured into the cavity in such a way that it fills the whole free space of the cavity of the mould 2. After the filling of the mould 2 the cavity is gradually deaerated through the finely porous ceramic wall of the shall. Basically immediately after the pouring of the melt to the form the melting of the foamable semifinished product 1—granules takes place, as well as its expansion, which is manifested by the reverse flow of the liquid 3—melt out of the intake. The outflow of the melt stops after approximately 15 seconds, which gives a signal that the expansion of the granules is finished. The mould 2 is left to cool to approximately 400° C. After the removal of the ceramic shell the finished component is taken out, whereby this component has a core produced by the aluminum foam with porosity approximately 80%. The foam is on the whole surface—which have been in the cavity covered by the stainless grid—covered by approximately 1 mm thick layer of the compact alloy AlMg1Si0.6 in which the grid has been welded, because the foam could not have reached the surface of the cavity of the mould 2 due to the grid and therefore has been unable to push out the melted alloy. In the same way the poreless metal appears in the bottom of the component, because the foam was not able to push out the melt from the area about the intake/outtake. The hybrid casting with the core from AlMg1Si0.6 foam and the poreless 1 mm thick surface layer produced by the same alloy results. The surface layer has been reinforced by the stainless expanded metal similarly to reinforced concrete. In the bottom part of the component the poreless layer of the alloy AlMg1Si0.6 with thickness approximately 20 mm, which is designed for the drilling of the fixing threads of the component, is produced.

Example 4

The rods according to FIGS. 38 to 43, produced from the aluminum technically pure powder and 0.4% weight of the powder of the foam agent $TiH_2$, were connected by the aluminum wires to the cap of the two-part foundry mould 2 produced from HBN in such a way that the dividing plane of the mould 2 is in the topmost part. The mould 2 basically constitutes a vessel covered by the cap. In the lowest part of the mould 2 (in the vessel) an intake is placed, whereby the pouring opening to the intake leads above the level of the dividing plane. The volume of the foamable semifinished product 1 takes up approximately 20% of the space of the cavity of the mould 2. The open lower part of the mould 2 (vessel) is heated to 850° C. and filled with the melted lead of the same temperature to at least ⅘ of the height of the vessel. the ccap of the mould 2 with the attached foamable semifinished product 1 is at the same time heated in the furnace to 550° C. where the expansion of the foamable semifinished product 1 does not take place, yet.

After the regularization (or evening out) of the temperature of the mould 2 and of the lead melt the cap with the attached foamable semifinished product 1 is pushed into the bottom part of the mould 2 by means of the pneumatic piston and the mould 2 is closed by the pressure. Immediately after the closure of the mould 2 and dipping of the foamable semifinished product 1 to the lead an expansion takes place, which manifests itself by the pushing of the lead out of the intake. The outflow of the lead stops after approximately half a minute, which gives a signal that the expansion of the granules is finished. The bottom mould 2—which after the closing by the cap and the beginning of the foaming basically immediately cools by approximately 150° C.—is left to cool to approximately 500° C. After the opening the finished component—completely produced by the aluminum foam with the overall porosity 78%—is taken out. All lead that had poured into the bottom part of the mould 2 has been pushed out by the expansion of the foamable semifinished product 1 outside the cavity of the mould 2 through the intake, whereby the intake is wholly filled by the foam, too.

Example 5

The process in this example according to FIGS. 18 to 26 is similar to the example 1. The mould 2 is different; here it has shape elements 6 preventing the pushing of the liquid 3 out of the mould 2 during the expansion of the foamable semifinished product 1. The liquid 3 in this example has an identical basis as foamable semifinished product 1.

The shape elements 6 are, for example, ribs into which the liquid 3 flows but is not supposed to flow out. On FIGS. 24 to 26 these zones are marked by the full black, which denotes the poreless mass of the solidified liquid 3 or—more precisely—solidified melt with the identical material basis as foam's basis. It is preferable if the cooling or reinforcing ribs have a full structure without the pores.

Example 6

Figure 32:
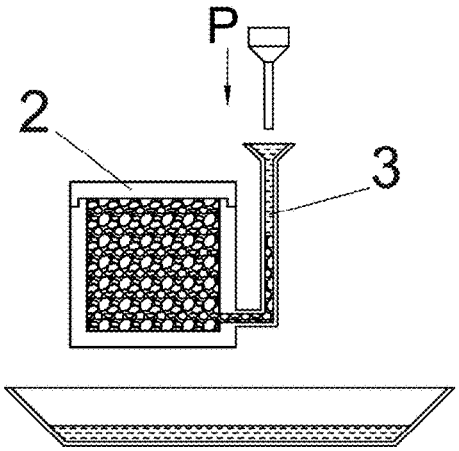

The method in this example according to FIGS. 27 to 32 is similar as the example 1 until the moment of the flowing of the liquid 3 out of the mould 2 where the pressure acts against the outflowing liquid 3 according to FIG. 32. The piston acting directly in the intake system is depicted schematically; various mechanical or hydraulic systems can be used in actual operation to created pressure. The structure of the foam can be controlled by means of the pressure. The mould 2 has an adequately firm construction in this example.

Example 7

Figure 34:
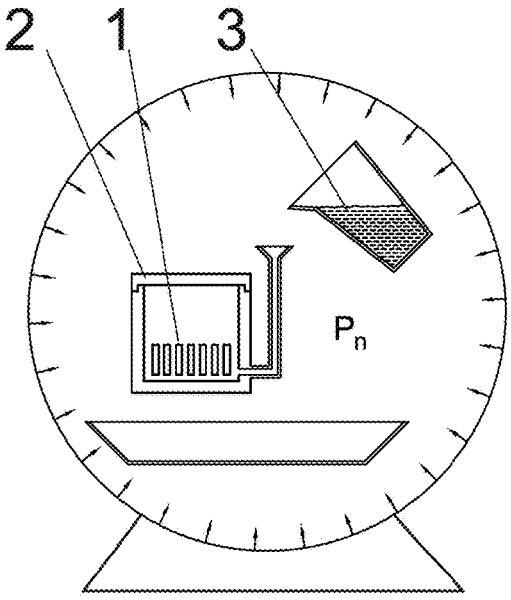
FIGS. 34 to 36 depict the steps with the gradual regulation of the pressure. The circle depicts the pressure vessel—for example autoclave—in which the mould is placed. The arrows heading from the circumference of the circle and the sign Pn depict the produced inner overpressure. The crossed-out letter P in the FIG. 36 denotes the ceasing of the overpressure.
Figure 35:
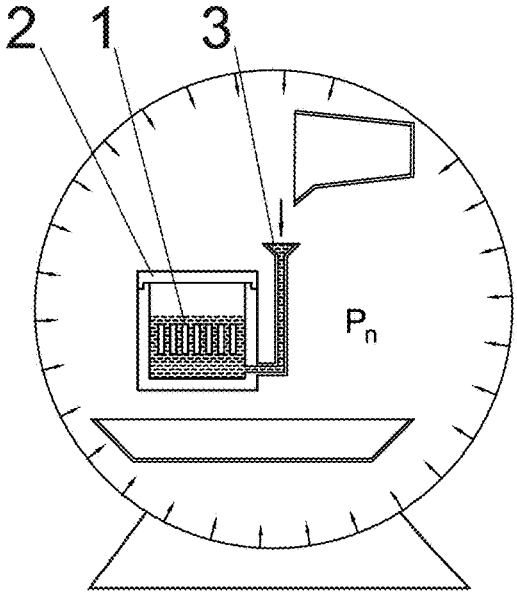
Figure 36:
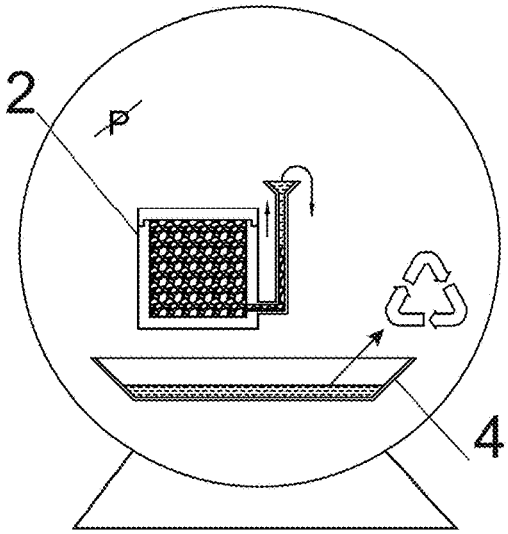

The usage of the autoclave according to FIGS. 34 to 36 in this example provides an important disposition for the launching of the expansion and influencing the resulting structure of the foam according to FIG. 33. The method according to FIGS. 27 to 32 is similar as in the example 1, but during the placement of the liquid 3 into the mould 2 the outside pressure Pn acts upon the mould 2 and the liquid 3 and prevents the launching of the expansion. The pressure acting upon the liquid 3 acts, at the same time, from the outside of the mould 2, so that the mould 2 does not need to be resistant to the overpressure Pn.

After the release of the pressure according to FIG. 36 the expansion and the outflow of the liquid 3 to the collecting vessel 4 starts.

Example 8

Figure 37:
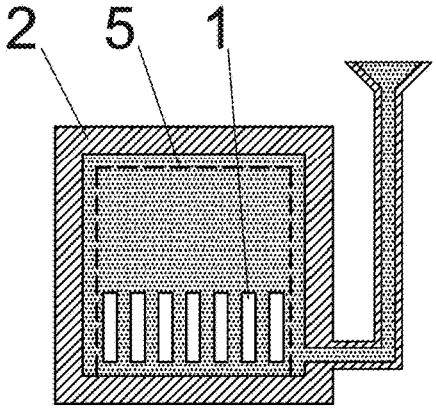
FIG. 37 depicts the usage of the undivided ceramic mould.
Figure 38:
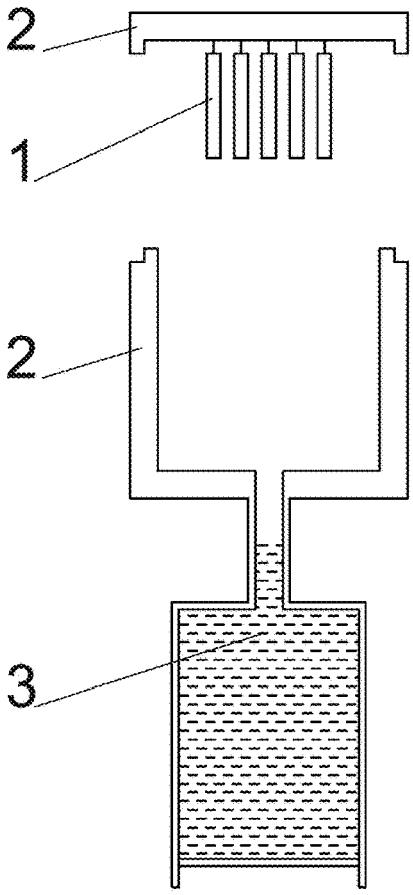
FIGS. 38 to 43 depict the steps of the foaming when the foamable semifinished product is placed into the mould which is already filled with the liquid.
Figure 39:
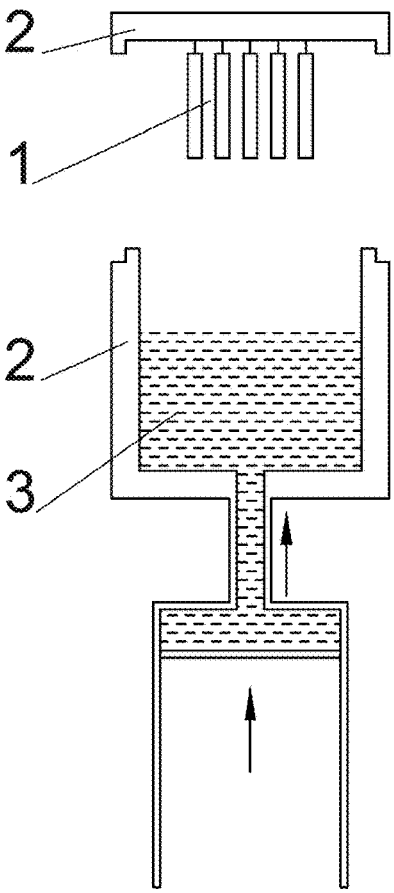
Figure 40:
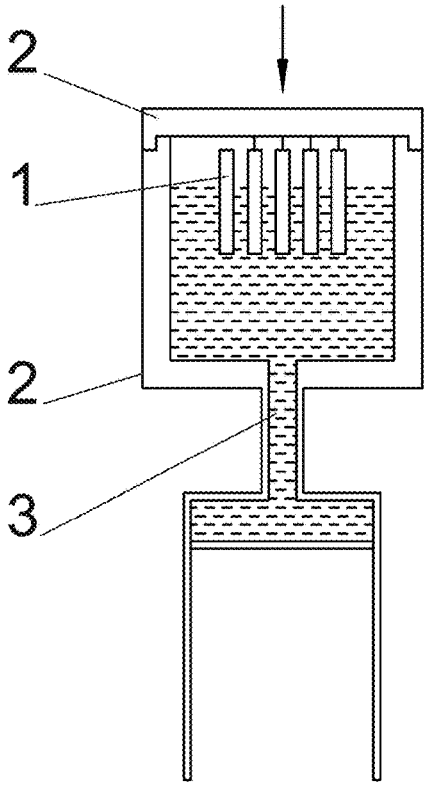
Figure 41:
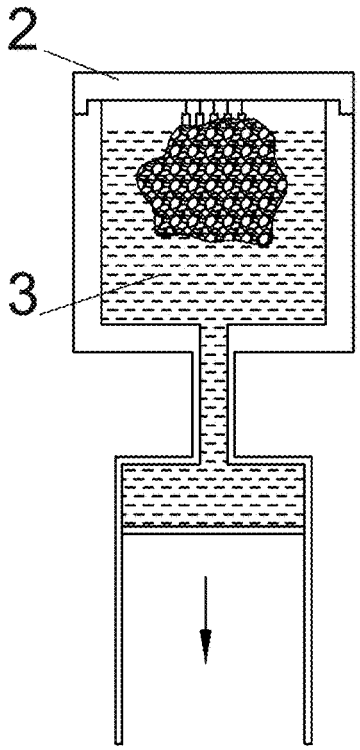
Figure 42:
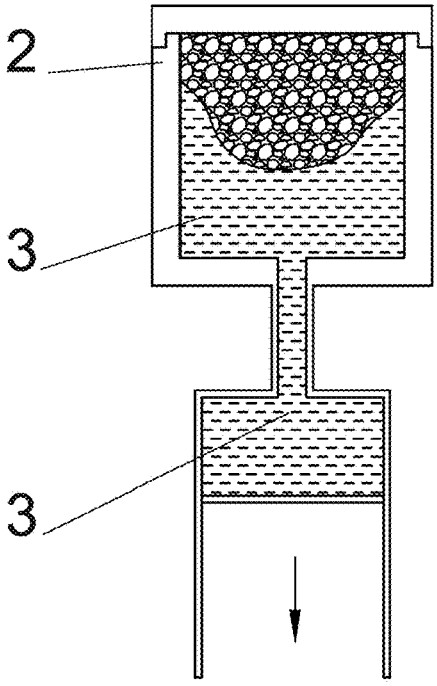
Figure 43:
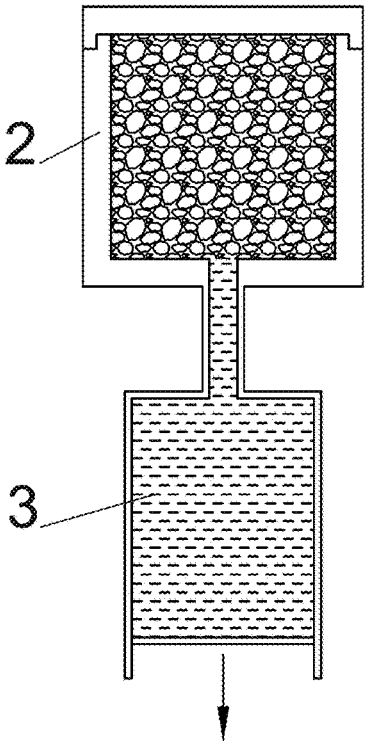

The mould 2 is undivided and one-off as depicted on the FIG. 37. The shell of the mould 2 is created by the non-metal, ceramic material; in particular the mould 2 is produced by the drying of the suspension containing ceramic particles applied onto the meltable wax model of the component. The common method known from the preparation of the wax model is supplemented by the fact that before the application of the layers of the shell the foamable semifinished product 1—and alternatively the reinforcement 5, too—is placed into the wax model or onto its surface. The foamable semifinished product 1 is not introduced into the mould 2 after its production, but during its production; the mould 2 basically grows around the mass of the foamable semifinished product 1.

INDUSTRIAL APPLICABILITY

The industrial applicability is obvious. According to this invention it is possible to industrially and repeatedly produce the components from the metal foam, including complex and large, sizable components, whereby the heat necessary for the foaming does not need to be transferred through the walls of the mould, which significantly diminishes the overall energy demands and production costs. The possibility of using cheap, one-off, but also complex and enduring moulds allow the effective production of different serial nature, ranging from prototypes to industrial mass production with high degree of automatization.

LIST OF RELATED ELEMENTS

1—foamable semifinished product
2—mould
3—liquid
4—collective vessel
5—reinforcement
6—shape element in the mould
HBN—Hexagonal Bornitrid

The invention claimed is:

1. A method of making a component from a metal foam, the method comprising the steps of:

inserting inside a cavity of a closable and/or one-off mould (2) a solid foamable semi-finished product (1) in the form of granules produced from a metal alloy and a foam agent;

heating the foamable semi-finished product (1) inside the mould;

flooding a cavity of the mould (2) with an amount of a liquid (3) having a temperature that is higher than a temperature at which the foamable semi-finished product (1) melts;

transferring a heat from the liquid (3) to the foamable semi-finished product (1) to heat the foamable semi-finished product (1), which produces gases in pores of the foamable semi-finished product to expand the foamable semi-finished product;

wherein the expanded foamable semi-finished product (1) is supported by the liquid (3), and wherein during the expansion, at least part of the liquid (3) goes out of the mould (2) through a respective opening in the mould (2); the liquid (3) is pushed out by the expansion of the foamable semi-finished product (1).

2. The method according to the claim 1, wherein the liquid (3) is placed into the mould (2) by injection through an opening in a bottom or the bottommost part of the mould (2) and later is also pushed out through the opening.

3. The method according to claim 1, wherein during the expansion, more than 75% of the amount of the liquid (1) is pushed out of the mould (2).

4. The method according to claim 1, wherein a part of the liquid (3) remains in the mould (2), the part of the liquid (3) remaining in the mould solidifies on the mould together with the foam and creates a hybrid casting combining a solidified foam and a solidified liquid into a single monolithic component.

5. The method according to claim 1, wherein a free space remaining in the cavity of the mould (2) after placing the foamable semi-finished product is partially filled with the liquid (3), wherein a volume of the liquid (3) and the foamable semi-finished product (1) before the expansion step is smaller than an inner volume of the cavity of the mould (2).

6. The method according to claim 5, wherein the amount of the liquid (3) is determined on basis of the weight and granulometry of the foamable semi-finished product (1).

7. The method according to claim 1, wherein during the contacting step of the foamable semi-finished product (1) with the liquid (3), the liquid (3) is exposed to a pressure, which at a given temperature, is higher than a pressure preventing the foam agent from releasing a gas necessary for foaming and the expansion, wherein before the decrease in the temperature of the liquid (3) to the temperature of a solidification of the foam, a pressure of the liquid (3) diminishes below the value preventing the foam agent from releasing the gas at the given temperature.

8. The method according to claim 1, wherein:

the liquid (3) is a melt of a metal with a temperature of melting that is lower than the temperature of a solidification of the metal foam; or the liquid (3) is a melt of a metal with a temperature of melting that is higher than the temperature of the solidification of the metal foam.

9. The method according to claim 1, wherein the liquid (3) is a melt of a metal alloy having an identical chemical composition as the metal alloy of the foamable semi-finished product (1).

10. The method according to claim 1, wherein before the flooding of the liquid (3), a metal and/or a ceramic reinforcement (5) is inserted into the cavity of the mould (2), wherein the shape of the metal and/or the ceramic reinforcement (5) is selected from the group consisting of nets, grids, rods, hollow profiles, wires, fibers, and mixtures thereof; the reinforcement (5) is inserted adjacently at a distance to an inner surface of the mould (2).

11. The method according to claim 10, wherein a perforation in the reinforcement (5) constitutes a sieve for a separation of the foam from the liquid on a surface of a finished casting.

12. The method according to claim 1, wherein before the flooding of the liquid (3) to the mould (2), the mould (2) is heated to a temperature higher than the temperature of the melting of the foamable semi-finished product (1).

13. The method according to claim 1, wherein during the pushing of the liquid (3) out of the mould (2), part of the liquid (3) remains in folds of the mould (2), wherein the part of the liquid (3) solidifies into shapes having different shapes than shapes on the mould (2).

14. A component containing the metal foam produced by the method according to claim 1;

wherein the component is a single piece component including a framework and an outer surface of a transportation device.

* * * * *